United States Patent [19]

O'Brian et al.

[11] 4,122,638

[45] Oct. 31, 1978

[54] FOLDING STRUCTURES CONSIDERED TO BE PRIMARILY USEFUL FOR PLAY PURPOSES

[76] Inventors: Edward D. O'Brian, 910 Iroquois, Anaheim, Calif. 92801; William M. Plachy, 3353 San Marcos Blvd., San Marcos, Calif. 92069

[21] Appl. No.: 786,884

[22] Filed: Apr. 12, 1977

[51] Int. Cl.[2] ..... E04B 1/344

[52] U.S. Cl. ..... 52/70; 217/14; 217/46; 5/99 B; 312/258

[58] Field of Search ..... 52/69, 70; 217/14, 46; 220/6; 312/258; 5/99 R, 99 B

[56] References Cited

U.S. PATENT DOCUMENTS

| | | | |
|---|---|---|---|
| 921,789 | 5/1909 | Baker | 217/46 |
| 1,001,051 | 8/1911 | Kohout | 220/6 |
| 2,059,058 | 10/1936 | Swanson | 5/99 R |
| 2,471,462 | 5/1949 | Toth | 217/14 |
| 3,094,714 | 6/1963 | Lates | 5/99 R |
| 3,525,451 | 8/1970 | Asser | 217/14 |

*Primary Examiner*—Ernest R. Purser
*Assistant Examiner*—Henry Raduazo
*Attorney, Agent, or Firm*—Edward D. O'Brian

[57] ABSTRACT

Folding structures useful for a variety of different utilitarian and play purposes can be constructed so as to utilize a Sarrus linkage modified so as to include an overcenter toggle mechanism to reinforce the linkage against inadvertent or undesired folding from an expanded position. As used in accordance with the invention such a Sarrus linkage includes two non-folding members or walls which are connected by two separate folding wall structures. Each of such wall structures includes two non-folding parts, an intermediate hinge connecting such parts, and edge hinges connecting such parts to the non-folding members or walls. At least one of the connecting wall structures is formed so as to serve as an overcenter toggle which is capable of holding the two non-folding members or walls in the expanded position while the other of the connecting wall structures serves to limit the movement of the non-folding members or walls away from one another so as to serve to apply pressure on the connecting wall structure serving as the toggle. The folding structures of the invention are useful as various different types of play equipment but are considered to have other utility.

16 Claims, 20 Drawing Figures

FIG. 1
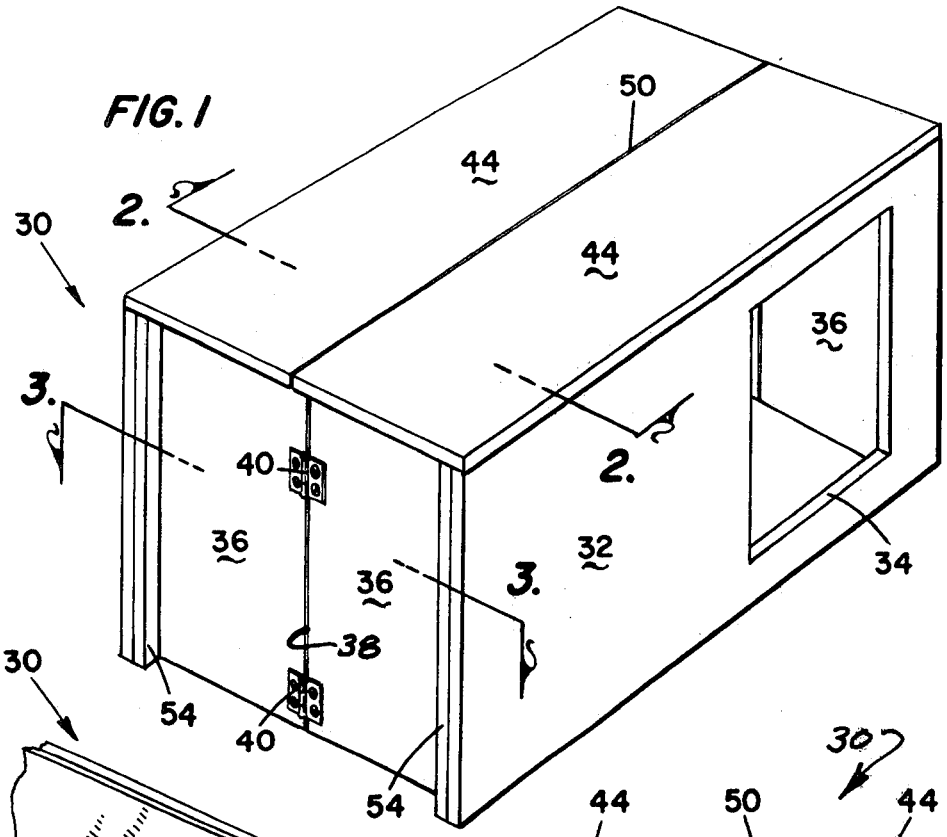
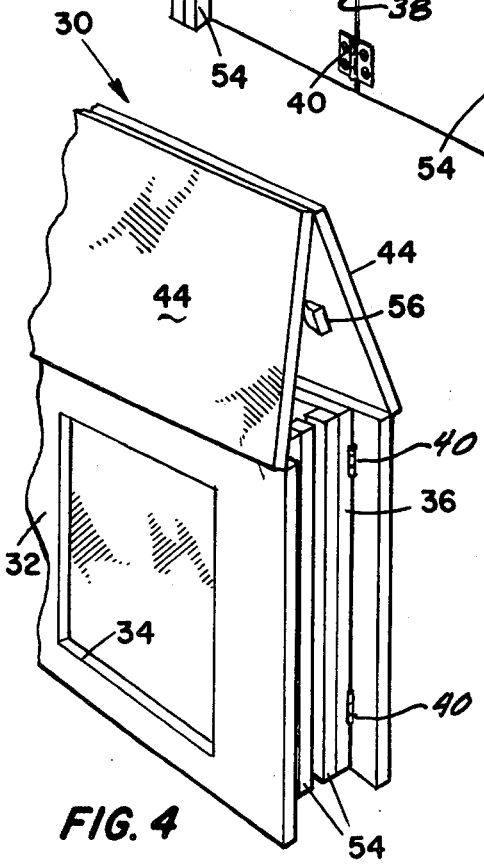
FIG. 4
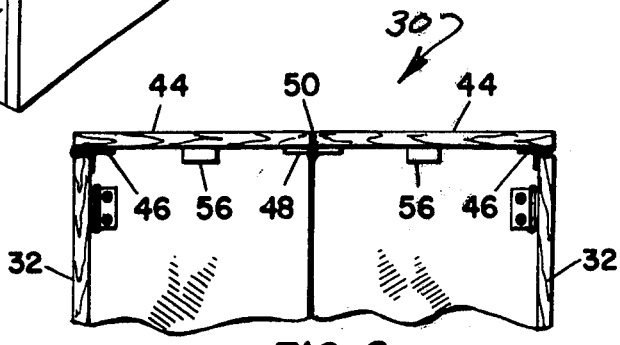
FIG. 2
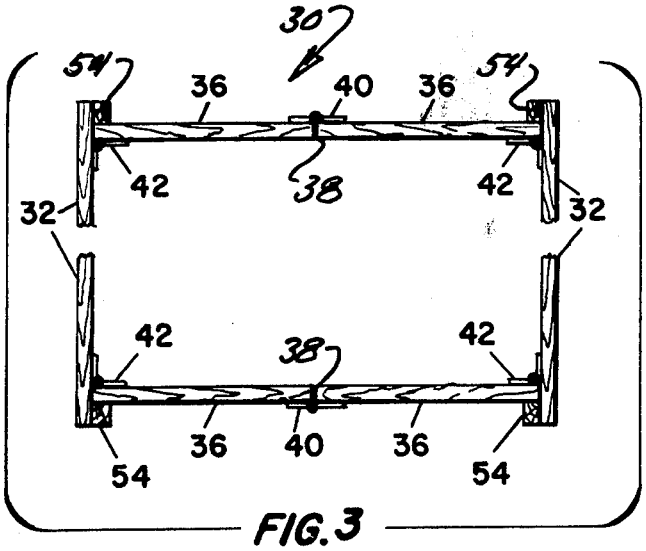
FIG. 3

FIG. 5
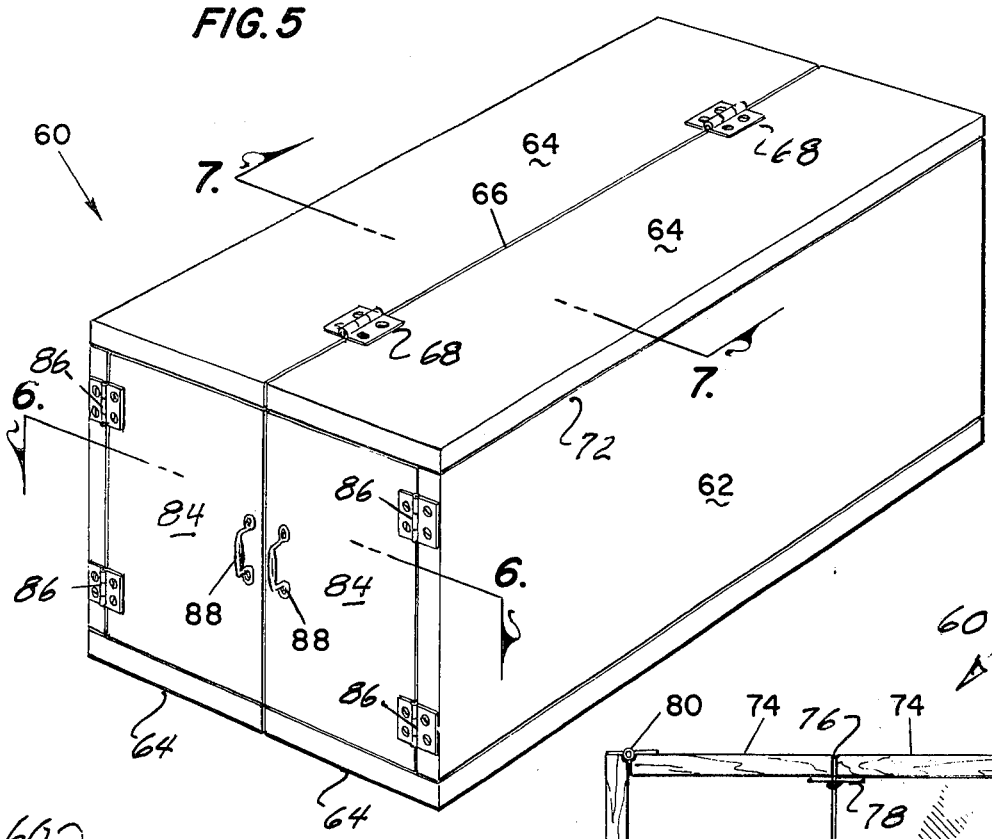
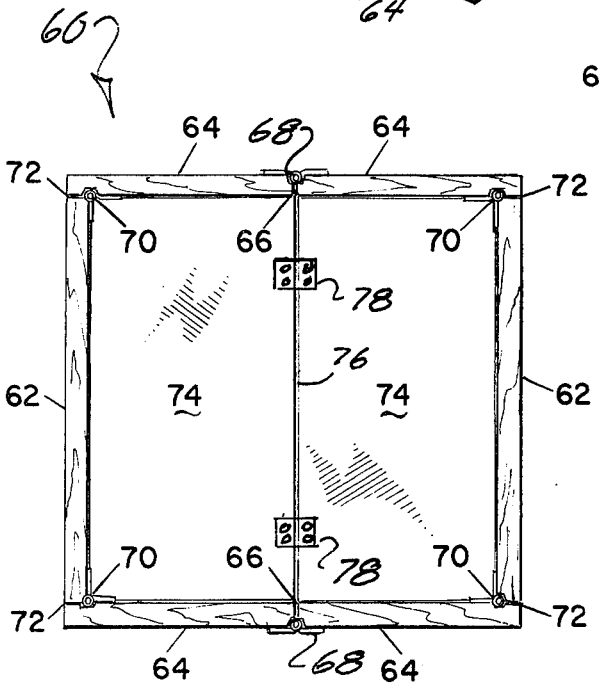
FIG. 7
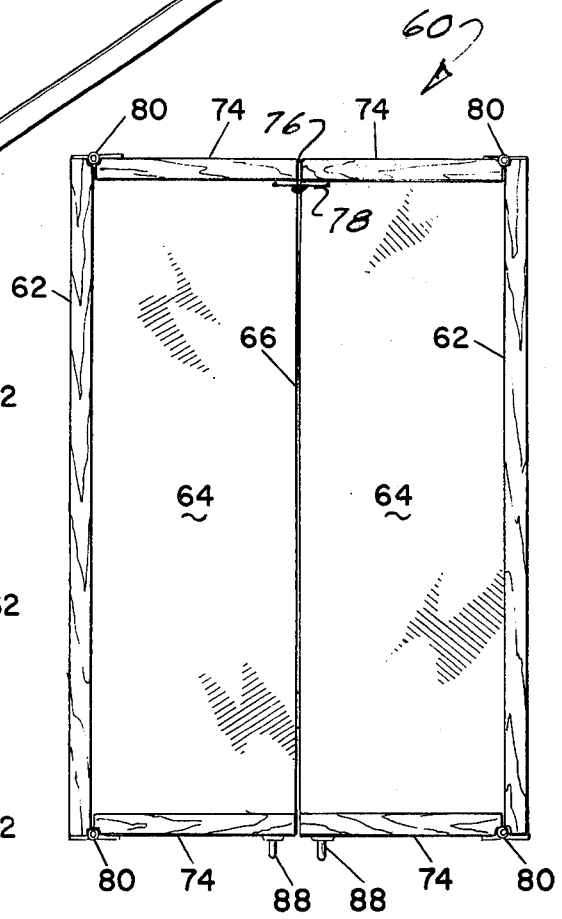
FIG. 6

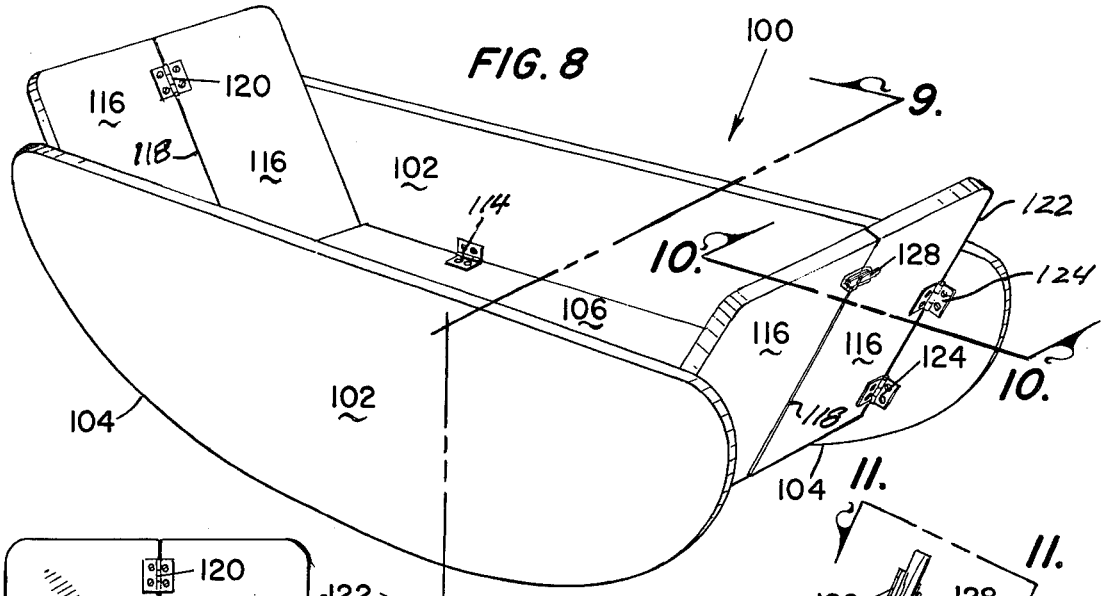
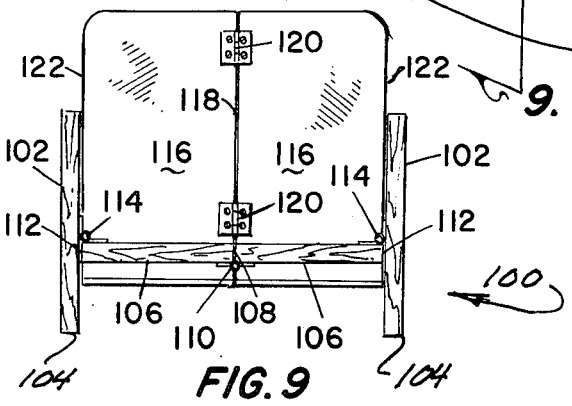
FIG. 9
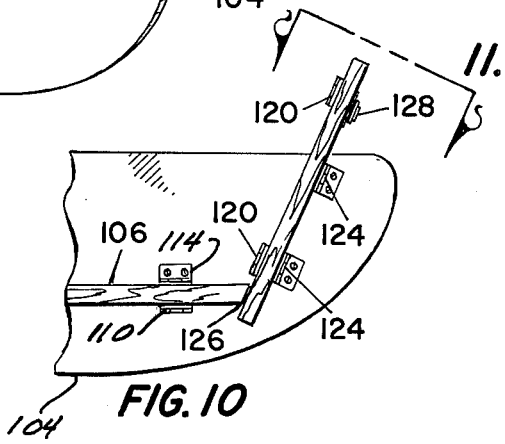
FIG. 10
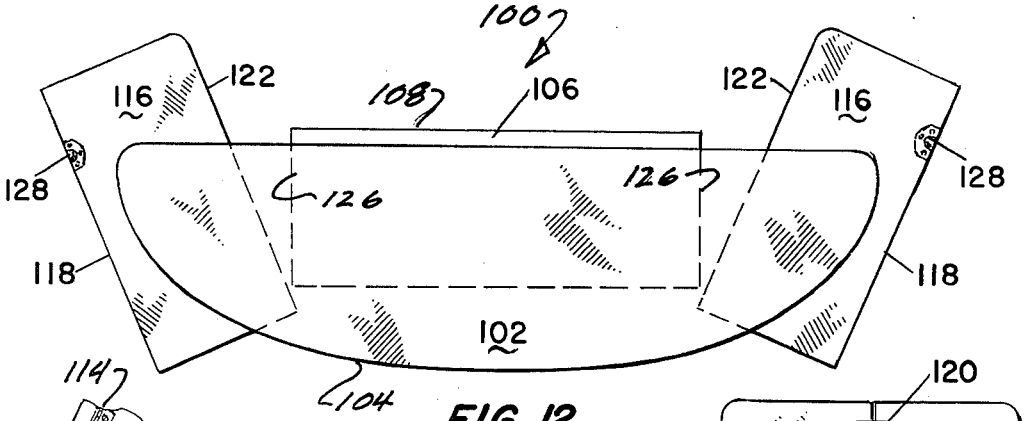
FIG. 12
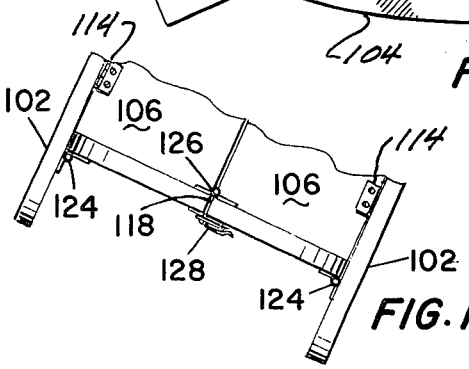
FIG. 11
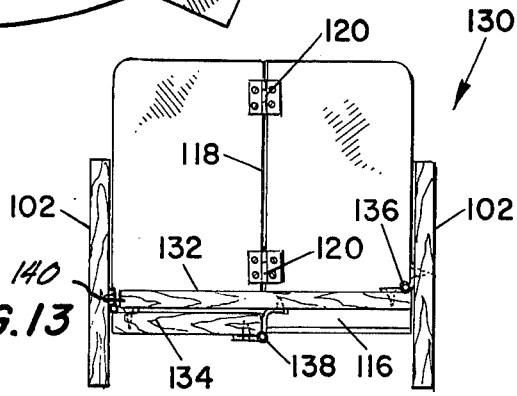
FIG. 13

FOLDING STRUCTURES CONSIDERED TO BE PRIMARILY USEFUL FOR PLAY PURPOSES

CROSS-REFERENCE TO RELATED APPLICATIONS

This application contains subject matter which to a degree is related to the subject matter set forth and claimed in the co-pending Edward D. O'Brian et al. application Ser. No. 752,104, filed Dec. 30, 1976, entitled "FOLDABLE STRUCTURES CONSIDERED TO BE PRIMARILY USEFUL AS DOGHOUSES". The entire disclosure of this co-pending application is incorporated herein by reference.

BACKGROUND OF THE INVENTION

The invention set forth in this application pertains to new and improved folding structures. More specifically this specification is directed toward folding structures which are considered to be primarily useful for play purposes. It is considered, however, that the principles or concepts of the invention are applicable to a wide variety of diverse structures employed for other purposes.

One of the problems encountered in connection with the care of comparatively small children in a home or in an appropriate child care facility concerns providing adequate equipment for play purposes within the physical space available in such a home or child care facility. It is well established that no one item of play equipment will continuously hold the attention of a child. Further, if the mentality of the child is to grow the child must be continuously exposed to various different types of play equipment. Normally no home has the physical space necessary to supply children with a sufficient number of different items of play equipment to effectively stimulate the development of a child.

To a degree this has been recognized and has resulted in the development of comparatively few items of play equipment capable of being easily disassembled for storage purposes and/or being capable of being manipulated so as to occupy a comparatively small volume for storage purposes. In general there have been few items available for common use which are of such a character that they have been capable of being easily and conveniently collapsed so as to occupy a limited amount of space stored during periods of non-use by children even though there has been a continuing need for many such items.

BRIEF SUMMARY OF THE INVENTION

A broad objective of the invention is to provide items of play equipment which are capable of being stored in a comparatively small, folded or collapsed configuration or position but which can be easily and conveniently manipulated to an expanded configuration for play purposes. It is considered that there is a need for such items because normally a home or child care facility does not have the physical space necessary to contain a large number of different items of play equipment as are necessary to effectively promote child development. The invention is intended to provide various folding structures which are of such a character that they may be easily and conveniently manipulated between such a folded or collapsed configuration in which they can be conveniently stored, to an expanded configuration for use by a child.

Although the present invention is primarily directed to folding structures which are primarily adapted for use for play or child development purposes it is considered that the various structures falling within the scope of the invention are of such a character that they can be utilized in connection with other applications than in the child development field. A broad object of the present invention is therefore also to supply new and improved folding structures which can be utilized for a wide variety of different purposes. Other objectives of the invention are to provide folding structures which are not significantly difficult to construct, which are not particularly expensive, and which can be easily and conveniently manipulated between folded or collapsed and expanded or unfolded configurations.

In accordance with this invention these various objectives are achieved by providing a folding structure having two walls, and folding means permitting the walls to be manipulated between a collapsed position in which the walls are adjacent to one another, and an expanded position in which the walls are further apart than in said collapsed position, the folding means including two different connecting wall structures which are located so as not to be parallel to one another when the walls are in the expanded position, each of the connecting wall structures including two non-folding parts, an intermediate hinge and two edge hinges, these parts being connected by the intermediate hinges so as to be capable of being folded relative to one another, one of the parts being connected to one of the walls by one of the edge hinges, the other of the parts being connected to the other of the walls by the other of the edge hinges, the axes of the intermediate and edge hinges of each of the wall structures being located relative to one another so as to permit the members to be manipulated between the expanded and collapsed positions by folding the parts of the wall structures relative to one another in which the improvement comprises: one of said wall structures serving as an overcenter toggle means for holding the walls in an expanded position while the other of the wall structures serves as a limiting means for preventing the walls from being moved so far apart that the overcenter toggle means is inoperative for its intended purpose.

Because the expressions "toggle means" and "overcenter toggle means" as used in the preceding are often misunderstood and/or ill defined it is considered that an understanding of the preceding and of the invention set forth in this specification requires that these terms or expressions be defined. As used herein the terms "toggle", "toggle means" and "overcenter toggle means" are employed to designate a mechanism which includes two end parts connected together so that they are spaced from one another and so that they are either relatively immovable or can only be moved relative to one another a limited extent and a member which may have several parts having ends which are constrained by engagement with the end parts, the member, the end parts, or both, being capable of temporarily changing in position or configuration when force is applied to the mechanism so that at least a portion of the member passes through an imaginary line between the constrained ends of the member.

It is considered that the aforegoing essentially designates what is referred to as a Sarrus linkage modified so as to include an overcenter toggle used in such a manner as to hold the two walls so that they are spaced from one another when a folding structure is in the expanded or unfolded configuration or position. Many folding structures in accordance with the invention can be constructed in such a manner as not to utilize such an overcenter toggle type mechanism and instead to substitute either no means for holding the various parts in an expanded configuration or to substitute various conventional fasteners to hold the parts in an expanded configuration or position. On occasion it may be desired to utilize both a conventional fastener as well as an overcenter toggle in connection with a folding structure in accordance with this invention in order to prevent accidental or inadvertent folding of such a structure.

BRIEF DESCRIPTION OF THE DRAWINGS

It is considered that the invention is best more fully explained with reference to the accompanying drawings in which:

FIG. 1 is an isometric view of a folding structure useful for play purposes in an expanded or unfolded configuration;

FIG. 2 is a partial cross-sectional view taken at line 2—2 of FIG. 1;

FIG. 3 is a cross-sectional view taken at line 3—3 of FIG. 1;

FIG. 4 is an isometric view of the structure shown in FIG. 1 in a folded configuration or position;

FIG. 5 is an isometric view of a modified folding structure considered useful for play and other purposes in an expanded or unfolded configuration;

FIG. 6 is a cross-sectional view taken at line 6—6 of FIG. 5;

FIG. 7 is a cross-sectional view taken at line 7—7 of FIG. 5;

FIG. 8 is an isometric view of a folding structure useful for play purposes in an expanded or unfolded configuration;

FIG. 9 is a cross-sectional view taken at line 9—9 of FIG. 8;

FIG. 10 is a partial cross-sectional view taken at line 10—10 of FIG. 8;

FIG. 11 is a partial top plan view taken in the direction of the arrow 11 in FIG. 10;

FIG. 12 is a side elevational view of the structure shown in FIG. 8 in a folded configuration or position;

FIG. 13 is a view corresponding to FIG. 9 of a modified form of the folding structure illustrated in FIG. 8;

Figure 15:
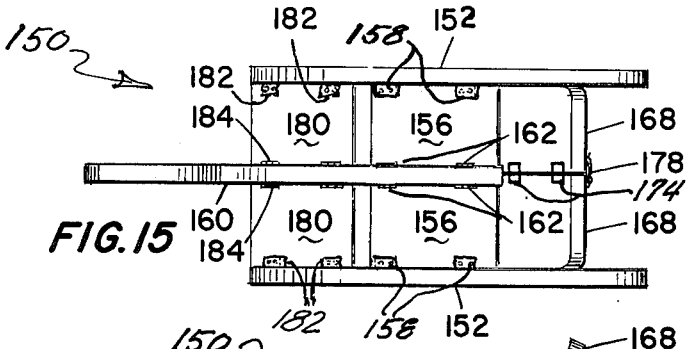
FIG. 15 is a top plan view of the structure shown in FIG. 14.

Because of the nature of the invention it is considered impossible to effectively designate any particular structure as illustrated in the drawing as a "preferred structure". A particular structure such as that illustrated in FIG. 18 may be preferred for certain types of utilitarian or play applications while other structures illustrated may be preferred for different types of play or utilitarian applications. It is not to be considered that various structures illustrated and described are all of the structures which can be manufactured in accordance with the principles or concepts of the invention. These principles or concepts are set forth and defined in the claims forming a part of this specification. They may be utilized on the basis of the disclosures embodied within this specification in a wide variety of diverse ways through the exercise of routine engineering skill.

DETAILED DESCRIPTION

In FIGS. 1 to 4 of the drawing there is shown a folding structure 30 of the present invention which is considered to be particularly useful for play purposes. This folding structure 30 is constructed so as to utilize parallel side walls 32 each of which is provided with an entrance opening 34. These walls 32 are connected by two sets (not separately numbered) of end walls 36, each of these sets consisting of two identical of these walls 36. The ends walls 36 have adjacent edges 38 which are connected by hinges 40 located on the sides (not separately numbered) of the walls 36 which are exposed when the structure 30 is in an unfolded or expanded configuration or position as indicated in FIG. 1.

The walls 36 are also connected to the walls 32 by other hinges 42 which are parallel to the hinges 40 in such a manner that the walls 36 will pivot inwardly during the manipulation of the structure 30 from an unfolded configuration as indicated in FIG. 1 to a folded configuration as indicated in FIG. 4. It will be noted that the hinges 40 and 42 are all parallel to one another but are offset with respect to one another when the structure 30 is in an expanded or unfolded configuration as shown in FIG. 1.

The structure 30 also includes top walls 44 which overlie and rest against the walls 32 and 36 in an unfolded position. These walls 44 are connected to the walls 32 by means of hinges 46 and are connected to one another by further hinges 48. It will be noted that the hinges 46 and 48 all lie within a common plane (not separately numbered) when the structure 30 is unfolded and that the walls 44 have edges 50 which abut against one another so as to limit rotation of the top walls 48 so that these walls 48 may move between a flat, coplanar configuration as indicated in FIG. 1 and a folded configuration as indicated in FIG. 4.

As opposed to this the hinges 40 and 42 are offset with respect to one another by the thickness of the walls 36. The edges 52 of the walls 36 which abut against one another and against the walls 34 are of such thickness as to preclude rotation of the walls 36 from a position as shown in FIG. 4 past a position as shown in FIG. 1. If desired edge strips 54 can be located on the end walls 36 or on the side walls 32 as sort of back up strips to prevent over-rotation of the walls 36 as the structure 30 is manipulated between open and closed positions as indicated in FIGS. 1 and 4.

From a consideration of the structure 30 it will be realized that this structure is based upon a Sarrus linkage but that it differs from a conventional Sarrus linkage inasmuch as the end walls 36 and the hinges 40 and 42 associated with them are connected in such a manner as to serve as a type of overcenter toggle (not separately numbered) which serves to apply an expansive force to the top walls 48 adjacent to where these walls 48 are connected to the side walls 32 as the end walls 36 are manipulated into or out of an open position as indicated in FIG. 1. In essence this type of construction modifies a Sarrus linkage so as to utilize an overcenter toggle action to lock the linkage in an open configuration or position.

It will be realized that in order to obtain the type of overcenter toggle action described that the distances between the axes (not separately numbered) of the hinges 40 and 42 must exceed the distance between the axes of the hinges 46 as the structure 30 is manipulated into a folding position as shown in FIG. 1 or is manipulated out of such a position. With the structure 30 this differential in length results from the fact that the hinges 40 and 42 are located on opposite surfaces of the end walls 36. If desired a variety of different expedients can be utilized to supplement the type of toggle action obtained. As an illustration of this ratchet-like ramps 56 may be located on the top walls 48 for the purpose of engaging the end walls 36 to hold these end walls 37 apart except when a deliberate upward pressure is applied to the top walls 48.

The toggle action achieved in the structure 30 is fundamentally related to the fact that the walls 32, 36 and 44 are inherently somewhat flexible and resilient in character even though these walls may be formed out of a material such as wood which is normally considered to be stiff and rigid. In the structure 30 the inherent resiliency of the materials used in the walls 32, 36 and 44 serves to provide the necessary spring action necessary for an overcenter type toggle. With the structure 30 the toggle type action is most pronounced adjacent to the top walls 44 because of the constraining effect of these walls 44. The toggle action achieved is not particularly pronounced toward the extremities (not separately numbered) of the walls 32 and 36 because of the manner in which hinges normally operate with the pins (not separately numbered) fitting loosely within them.

Because the entire structure 30 unfolds from a flat position as indicated in FIG. 4 to an expanded position as indicated in FIG. 1 in such a manner that the structure 30 is comparatively rigid in this expanded configuration, it is considered that the structure 30 is suitable for a wide variety of different play purposes. This particular structure 30 is in the nature of a combination play platform and simulated building which can be utilized in a wide variety of diverse ways. Obviously the structure 30 can be supplemented so as to enhance its value for play purposes. As an example of this various different openings may be provided within the walls 32 and 36. Further, the basic structure 30 can be expanded so as to include a folding rail structure using Sarrus folding (not shown) located parallel to the walls 44 when these walls 44 are coplanar if this is desired.

In FIGS. 5 and 7 of the drawing there is shown a modified structure 60 which in many respects is similar to the structure 30. It also has identical parallel side walls 62 of a rectilinear configuration which are connected by two sets (not separately numbered) of identical walls 64. These walls 64 have adjacent edges 66 connected by hinges 68 and are connected by the walls 62 by means of further hinges 70 in such a manner that the walls 66 are capable of being folded inwardly so as to lie generally parallel to and between the walls 62 when the structure 60 is in a collapsed position. It will be noted that in a normal expanded position of the walls 62 that the walls 64 overlie the edges 72 of the walls 62 in such a manner that the abutting contact between the wall 64 and the edges 72 serves to limit the rotation of the walls 64 relative to the walls 62.

In order to provide for stability of the structure 60 it is necessary to utilize in connection with it a set (not separately numbered) of two identical end walls 74. These end walls 74 have adjacent edges 76 connected by hinges 78 and are pivotally mounted on the walls 62 by means of further hinges 80. These hinges 78 and 80 are located in such a manner that the end walls 74 may be pivoted outwardly generally away from the side walls 62 as the structure 60 is being manipulated from an expanded position as indicated in FIG. 5 to a folded position. In order to provide clearance for the inward folding of the walls 64 as the end walls 74 pivot outwardly it is considered necessary to bevel the corners of the walls 74 adjacent to the side walls 62.

Although it is possible to form the structure 60 as a complete box-like structure by utilizing two sets (not separately numbered) of the end walls 74 at opposite extremities (not separately numbered) to the side walls 62 it is not considered that the use of such two sets of end walls 74 is desirable. Instead, it is possible to modify the structure so as to mount on the side walls 62 doors 84 connected to the side walls 62 by hinges 86 so as to permit access to the structure 60 whenever desired. These doors 84 are, of course, pivoted outwardly so as to permit folding of the structure 60. Conventional handles 88 are used with these doors 84. If desired conventional latches (not shown) may also be used.

In order to increase the value of the structure 60 for play purposes, it is normally preferable to locate within the side walls 62 or the end walls 74 and/or the doors 84 one or more window type openings or doors (not shown). The structure 60 can also be modified in a number of other obvious ways. All such modifications are considered to be matters within essentially routine skill and are not considered to detract from the type of action achieved with the structure 30. In this structure 60 the walls 64 are constructed so that each of the sets of these walls 64 serves to limit the inward movement of the end walls 74. Thus, with this type of structure the end walls 74 and their associated hinges 78 and 80 in effect act as an overcenter toggle (not separately numbered) while the walls 64 serve to constrain movement of the side walls 62 to a sufficient extent to obtain a toggle action.

Normally this toggle action will be sufficient so that there will be no need to employ an auxiliary means such as an external fastener 90 to secure the walls 74 in an expanded configuration. It is of course possible to employ such a fastener 90 or other equivalent expedients was a safeguard against undesired folding. This structure 60 is considered to be primarily of utility as a type of playhouse which can be temporarily located in virtually any location—including locations spaced above the ground. It can of course be utilized for other purposes.

In FIGS. 8 to 11 there is shown another structure 100 employing the principles of the invention which effectively indicates that the invention does not primarily relate to structures employed for playhouse type purposes but instead can be employed for structures for a variety of play purposes. This further structure 100 is a type of rocker having identical side walls 102 terminating in curved lower edges 104 which are adapted to rock back and forth along an appropriate supporting surface (not shown).

This structure 100 includes identical bottom walls 106 adapted to be located in edge to edge relationship between the walls 102 so as to have adjacent edges 108 joined by hinges 110 and so as to have side edges 112 joined to the side walls 102 by further hinges 114. The axes of the hinges 110 and 114 are parallel. These hinges 110 are located on the bottom surfaces (not separately numbered) of the walls 106 while the hinges 114 join the upper surfaces (not separately numbered) of the walls 106 to the side walls 102.

The structure 100 also includes two sets (not separately numbered) of end walls 116 having adjacent ends 118 joined by hinges 120 and side edges 122 joined by hinges 124 to the side walls 102. Here again the hinges 120 and 124 are located on opposite surfaces (not separately numbered) of the end walls 116 so as to permit these end walls 116 to fold outwardly from the bottom walls 106 as the side walls 102 move inwardly from an expanded position to a collapsed position. It is noted that the end walls 116 are located at an angle to the bottom walls 106 in such an expanded position of the side walls 102 and that the bottom walls 106 are provided with beveled edges 127 which rest against the end walls 116 when the structure 100 is unfolded.

The structure 100 is designed in such a manner that either the bottom walls 106 or the end walls 116 can be considered as a toggle since the hinges associated with these walls are located on opposite surfaces (not separately numbered) of them. Such locations of the hinges on both the bottom walls 106 and the end walls 116 are desirable in order to facilitate folding. With a structure 100 as described the distances between the hinges 114 and the hinges 124 when the structure 10 is in an expanded position may be made so as to be equal so that both the bottom walls 106 and the end walls 116 may be concurrently pivoted into their expanded or in use positions. As a practical matter it is considered virtually impossible to normally obtain such a condurrent action because of the normal tolerances of hinges.

To achieve a "firm" toggle type locking action it is preferred to manufacture a structure such as the structure 100 so that the total distance between the hinges 114 connecting the bottom wall 106 to the side walls 102 when the structure 100 is expanded or unfolded in greater than the total distance between the hinges 124 connecting the end walls 116 to the side walls 106 when the structure 10 is in this configuration or vice versa. As a consequence of this the shorter of the two distances between either of the hinges indicated will act as a limiting distance, limiting the amount that the side walls 102 will move apart as walls are moved to an overcenter position so as to be locked in place.

At the present time it is considered preferable to construct the bottom walls 106 so that the total distance between the hinges 114 when the bottom walls 106 are in an expanded or unfolded configuration is slightly greater than the total distance between the hinges 124 as the walls 116 are in the same position. When this dimensional relationship is used a toggle action is achieved as the complete structure 100 is placed in an expanded or unfolded configuration which effectively locks the side walls 102 in place along their lengths. Further, the walls 106 will then fit against the walls 116 so as to tend to hold these walls 116 in place. Further, the weight of one or more children using the structure 100 will tend to hold the walls 106 against any inadvertent force which might tend to collapse or fold up the structure 100 to even a limited degree.

It is, of course, possible to modify the structure 100 so as to include conventional fasteners 128 such as toggle clasps on the walls 116 so as to hold these walls against inadvertent movement out of an unfolded position. This is not considered to be normally necessary when the dimensional relationships of the various parts are as noted. However, the use of such fasteners 128 may be desirable in those cases where it is anticipated that children may turn a structure 100 upside down during play so as to utilize this structure in various different ways or when the parts are dimensioned so that a toggle action is not achieved.

In FIG. 13 of the drawing there is shown a modified structure 130 which is based upon the structure 100. For this reason various parts of the structure 130 which are identical to corresponding parts of the structure 100 are not separately described herein and are designated in this specification and in the drawings by the numerals previously utilized in connection with such parts.

The modified structure 130 differs from the structure 100 by substituting for the bottom walls 106 a single bottom wall 132 which is adapted to extend between the side walls 102 when the structure 130 is in an expanded position and a link 134. With the structure 130 the bottom wall 132 is attached to one of the side walls 102 by a hinge 136. A further offset hinge 138 connects the link 134 and the bottom wall 132 midway between the side walls 102. This link 134 is connected to the other of the side walls 102 by a further hinge 140.

With this structure 130 the bottom wall 132 and the link 134 serve as toggle members firmly holding the sides 102 separate and apart from one another. It can be argued as to whether or not this structure 130 is more advantageous than the structure 100 because it has a solid bottom wall 132 extending between the side walls 102. The particular structure indicated using the bottom wall 132 and the link 134 is considered to be advantageous in obtaining a pronounced toggle action. If the various parts of the structure 130 are formed of a material or materials which will not temporarily deform to any significant extent, the dimensions of the structure 130 must be carefully controlled or the bottom wall 132 will not snap into place as the structure 130 is expanded.

Figure 14:
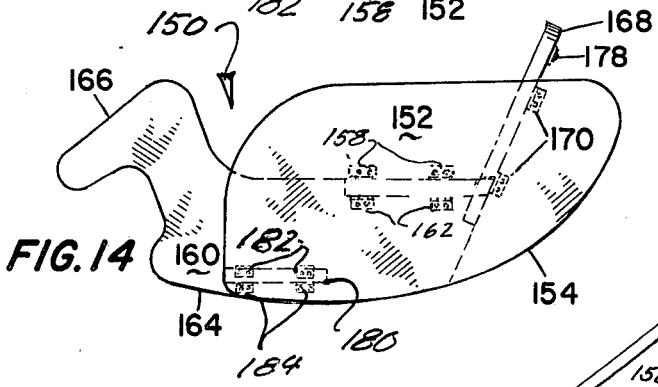
FIG. 14 is a side elevational view of a further modified folding structure useful for play purposes in an expanded or unfolded configuration.
Figure 17:
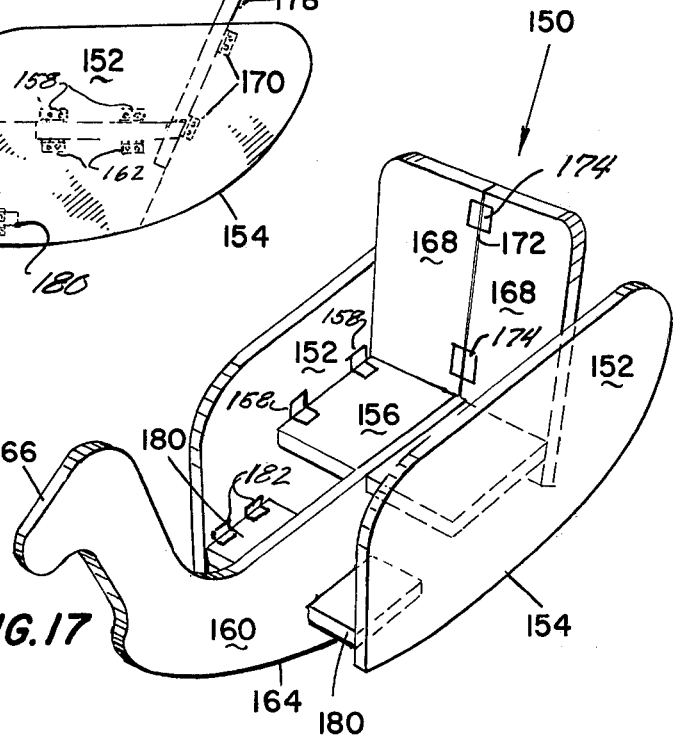
FIG. 17 is a side elevational view of the structure shown in FIG. 14.
Figure 16:
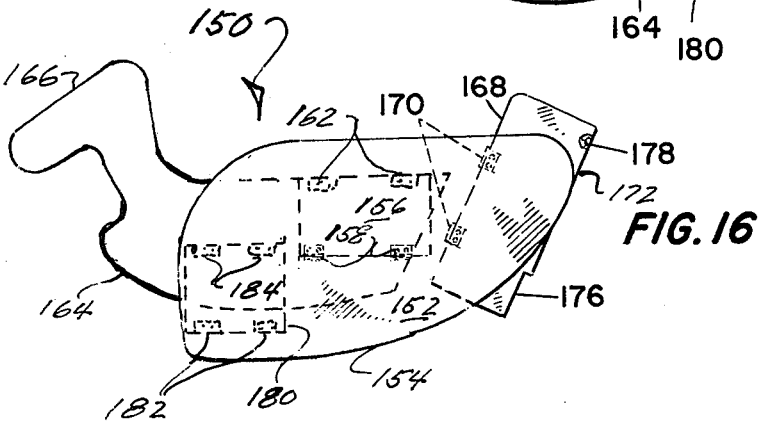
FIG. 16 is a rear elevational view of the structure shown in FIG. 14.

Both the structures 100 and 130 can be easily modified so as to be utilized as chairs. Essentially such modifications involve the separation of a structure 100 or 130 midway between the end walls 116 into two parts, each of which is capable of serving as a chair. Because of the simplicity of forming a chair based upon the principles employed in the structures 100 and 130 no such chair is illustrated in the drawings and/or specifically described in this specification. However, the principles employed in such a chair are illustrated in a structure 150 shown in FIGS. 14 through 16 of the drawings.

This structure 150 is in the form of a rocking toy or seat to a degree simulating what is commonly referred to as a "rocking horse". The structure 130 includes identical side walls 152 having lower edges 154 which are curved in a conventional manner as a rocking chair. Identical bottom walls 156 are connected to each of the side walls 152 by hinges 158 permitting these bottom walls 156 to be pivoted upwardly as the structure 150 is manipulated into a folded configuration. Both of the bottom walls 156 are connected to a center wall 160 by further hinges 162 so that as the walls 156 are pivoted upwardly this center wall 156 will also be pivoted upwardly.

It will be noted that the center wall 160 has a curved lower edge 164 corresponding to the edges 154 so as to permit this structure to be rocked back and forth. This edge 164, however, extends considerably in front of the bottom walls 156 in order to provide stability against the structure 150 being manipulated or moved so as to tend to "flip" over in a forward direction. This center wall 160 can conveniently be formed with a forepeak 166 simulating an animal's head so as to increase the value of the structure 150 for play purposes.

The side walls 152 and the center wall 160 are maintained parallel to one another in an unfolded or expanded position through the use of back walls 168 of a bilaterally symmetrically character. Each of the back walls 168 is connected to one of the side walls 152 by hinges 170 and adjacent edges 172 of these back walls 168 are connected through the use of further hinges 174. Because of the use of the structure 150 it is preferred that these hinges 174 be recessed slightly within the walls 168 so as not to project from them. It is noted that the walls 168 extend below the bottom walls 156 at an angle to the bottom walls 156 when the structure 150 is in the expanded or unfolded configuration. These back walls 160 contain notches 176 which accommodate or fit around the center wall 160 so as to serve to hold this center wall in a position parallel to the side walls 162.

With the described construction of the structure 150 the various parts described are preferably dimensioned so that the distance between the hinges 158 when the structure 150 is unfolded is slightly less than the distance between the hinges 170 as the hinges 174 are moved through an imaginary line between the hinges 170. This is so as to obtain the toggle action indicated in the preceding which will serve to space and hold the side walls 152 in an expanded position as indicated. As the back walls 168 are snapped into position the notches 176 accommodate the center wall 160 so as to effectively stabilize this center wall against significant movement.

Because of the nature of the structure 150 and the manner in which it is used it is preferred to supplement the toggle locking action indicated in the preceding through the use of a conventional fastener such as a toggle clasp 178. This fastener 178 is used on the back walls 168 in order to secure the adjacent edges 172 against movement when the structure 150 is in an expanded, unfolded position. Although it is possible to manufacture the structure 150 so that only the fastener 178 serves to reinforce the structure 150 against folding from an expanded position by forming the parts described so that no toggle action is readily apparent as, for example, through the use of hinges with very loose pins, it is preferred to use the fastener 178 and the toggle action described to supplement one another. This is considered to facilitate the manipulation of the structure 150 into an expanded configuration.

It is considered that this structure 150 can be modified in a number of different ways. As an example of this small connecting walls 180 serving as a footrest can, but need not, be employed. These walls 180 are connected to the side walls 152 through the use of hinges 182 and are connected to the center wall 160 through the use of further hinges 184. These hinges 182 and 184 are located relative to the center wall 160 in the same manner in which the bottom walls 156 are located relative to this center wall 160 so as to achieve a parallelogram type of folding action permitting the center wall 160 to pivot upwardly so as to be parallel to the side walls 162 as the structure 150 is manipulated from an unfolded or expanded position to a folded or collapsed position.

In effect the walls 180 not only serve as footrests but serve as stabilizers to control the position of the center wall 160 during folding and unfolding. This is considered to facilitate the manipulation of the structure 150 into an unfolded or expanded configuration. The walls 180 will, of course, exercise a stabilization function when they are located so as to be incapable of serving as a footrest.

Figure 18:
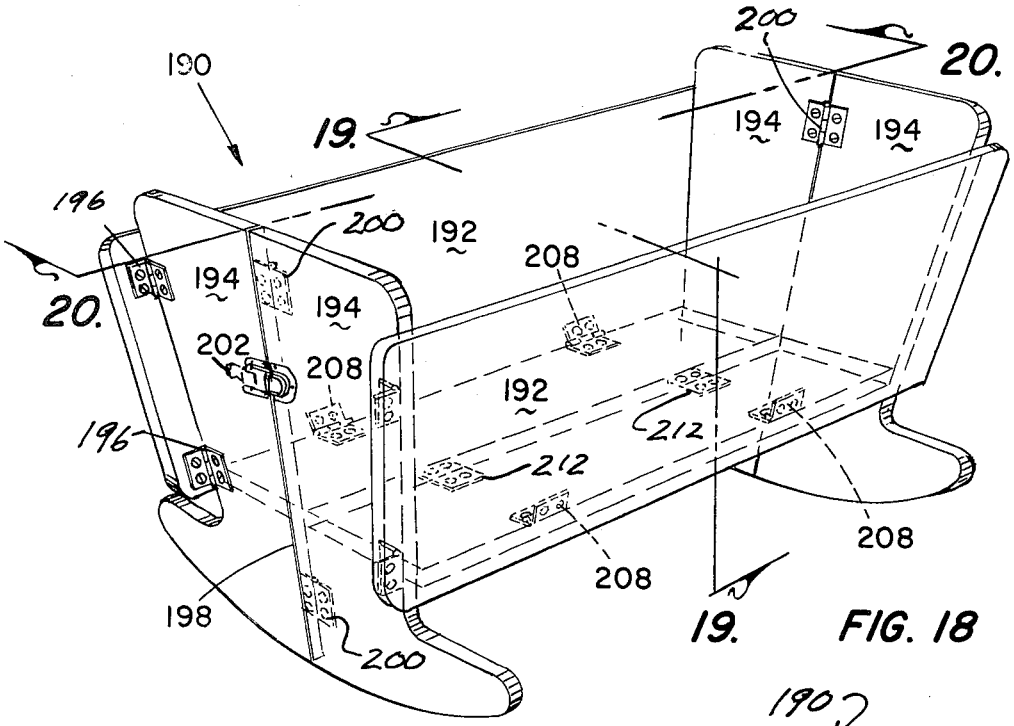
FIG. 18 is a side elevational view of another modified folding structure in accordance with the invention which is particularly useful as a crib.
Figure 20:
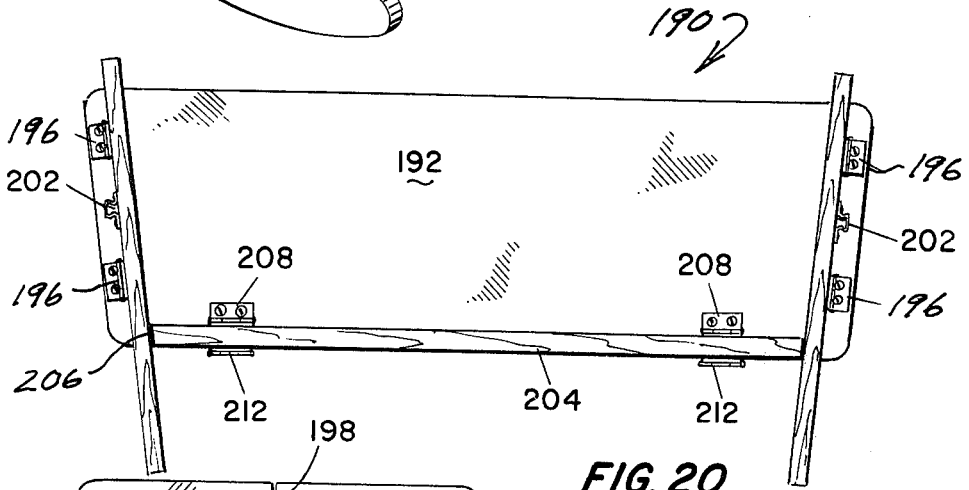
FIG. 20 is a partial cross-sectional view taken at line 20—20 of FIG. 18.
Figure 19:
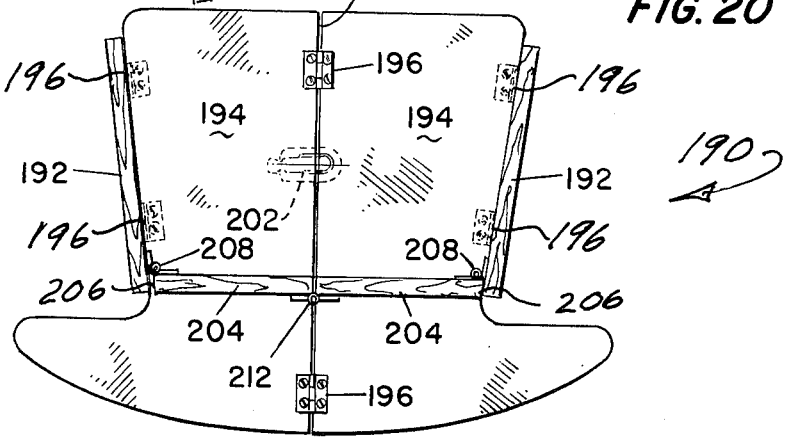
FIG. 19 is a cross-sectional view taken at line 19—19 of FIG. 18.

In FIG. 18 of the drawing there is shown a further structure 190 in accordance with this invention which is primarily useful as a cradle for either a doll, or, depending upon size considerations, for use with a baby. This structure 190 includes side walls 192 which are located at an angle to one another when the structure 190 is in an unfolded position. These side walls 192 are connected by bilaterally symmetrical end walls 194 through the use of hinges 196. Adjacent edges 198 of the walls 192 are also connected by other hinges 200 so that these end walls 194 will fold outwardly relative to the side walls 192 as the structure 190 is being manipulated to a collapsed configuration.

When the structure 190 is to be utilized as a crib with a human baby it is preferred to also couple the edges 198 of the end walls 194 against inadvertent folding through the use of a conventional fastener 202 such as a toggle clasp although the use of such a fastener is not considered to be an absolute necessity. In effect, such a fastener 202 serves as "insurance" against inadvertent folding of any part of the structure 190 out of an unfolded or expanded position.

The structure 190 also includes bilaterally symmetrical bottom walls 204 having beveled edges 206 which are adapted to fit closely against the side walls 192 and the end walls 194 when this structure 190 is in an unfolded or expanded position. These bottom walls 204 are connected together through the use of further hinges 212.

It is considered that it will be obvious from the description of the structure 190 that in many respects this structure is quite closely related to the previously described structure 100. With the structure 190 it is possible to utilize either the end walls 194 or the bottom walls 204 to accomplish a toggle action locking the other of these walls in a fixed or firm position by tending to spread the side walls 192 against the limiting action of the walls not serving a toggle function. With the structure 190 it is preferred that the bottom walls 204 be of such dimension that the combined distances between both of the hinges 208 and the hinges 212 be slightly in excess of the distances between the hinges 192 when the walls 194 are in place so that the bottom walls 204 achieve a locking action. These bottom walls 204 will of course be prevented from passing from an overcenter position to an undesired extent and will be prevented from sagging by the engagement of the beveled edges 206 against the side walls 102 and against the end walls 194. With the structure 190 any weight on the bottom wall 204 will have the effect of firmly securing the structure 190 against inadvertent or accidental folding.

In many respects the manner in which the structure 190 can be folded is quite similar to the manners in which the previously described structures can be folded. It will be noted that this structure 190 is quite similar to the structure 100. The principal differences pertain to the manner in which the parts are shaped in these two structures. Because the structure 190 is so similar to the structure 100 it is not considered necessary to illustrate this structure 190 in a folded configuration.

In describing the various different structures in the preceding it has not been considered necessary to specifically point out that all hinges designated by the same numeral are located so as to have a common axis. Neither has it been considered necessary to specifically point out that the folding action achieved in all of the structures is of an essentially bilateral symmetrical character about an imaginary plane located midway between the various side walls indicated. It is of course possible to substitute in any of the structures described various types of conventional pivot or pivot-type mechanisms for the hinges indicated.

Further, it is believed that it will be obvious that various structures indicated can be modified in various different ways. As an example of this the structure 190 could be modified so as to include a single bottom wall as indicated in FIG. 13. This is not considered to be desirable because of the amount that such a bottom wall would extend upwardly from between the side walls when the structure 190 is in a folded configuration. It is considered that many other such routine modifications may be made in adapting the principles of the invention to different applications.

Although the invention is primarily related to various structures which are derived from a Sarrus linkage and which are related to a Sarrus linkage by modifying such a linkage so as to achieve a toggle action, many of the specific structures indicated in the preceding and others falling within the scope of the invention which have not been illustrated are considered to be of a patentable character even when they are not constructed so as to obtain a toggle action locking the various parts in place. This is because many such other structures can be formed so that conventional fasteners will function in lieu of a toggle linkage to secure such structures in an unfolded or expanded configuration.

We claim:

1. A folding structure which includes:

two movable walls which during the folding and unfolding of said structure are moved toward and away from one another, a foldable limiting means connecting said walls for limiting the distance said walls may be moved away from one another, a foldable toggle linkage connecting said walls for holding said walls as far from one another as said limiting means allows said walls to be moved away from one another, said toggle linkage including at least two toggle links pivotally connected in end-to-end relationship, an end of one of said toggle links being pivotally connected to one of said walls, an end of another of said toggle links being pivotally connected to the other of said walls, said pivotal connections of said toggle linkage having axes located so that said toggle linkage passes through a position which is overcenter relative to the connections of said toggle linkage to said walls when said walls are spaced as far from one another as permitted by said limiting means, said toggle links of said toggle linkage in said unfolded position engaging one another and said walls so as to hold said walls as far from one another as permitted by said limiting means, said limiting means being under tension and said toggle links being under compression and restrained against movement by contact with one another and said walls and by the compressive forces of said limiting means as applied to said toggle linkage through said walls when said structure is unfolded.

2. A folding structure as claimed in claim 1 wherein:

said limiting means comprises at least two limiting links pivotally connected to one another in end-to-end relationship, an end of one of said limiting links being pivotally connected to one of said walls, an end of another of said limiting links being pivotally connected to the other of said walls, said pivotal connections of said limiting means being located so as to permit no further movement of said limiting means when said walls are spaced as far from one another as permitted by said limiting means and when said links of said toggle linkage are in said unfolded position.

3. A folding structure as claimed in claim 2 wherein: there are two of said limiting means.

4. A folding structure as claimed in claim 2 wherein: there are two of said toggle linkages.

5. A folding structure as claimed in claim 2 wherein: there are two of said toggle linkages and two of said limiting means.

6. A folding structure as claimed in claim 1 wherein:

said limiting means includes at least two limiting links pivotally connected to one another in end-to-end relationship, one end of one of said limiting links being connected to one of said walls, an end of the other of said limiting links being pivotally connected to the other of said walls, said pivotal connections of said limiting means having axes located so that said limiting means passes through a position which is overcenter relative to the connections of said limiting means to said walls when said walls are spaced as far from one another as permitted by said limiting means.

7. A folding structure as claimed in claim 6 wherein:

said limiting means includes a center wall located between said movable walls, said center wall being pivotally connected to said two limiting links, said toggle linkage including means for engaging and holding said center wall against movement only when said structure is unfolded.

8. A folding structure as claimed in claim 7 including:

fastener means for securing said links of said toggle linkage against movement when said movable walls are as far from one another as permitted by said limiting means.

9. A folding structure as claimed in claim 6 including:

fastener means for securing said limiting links of said limiting means against movement when said walls are as far from one another as permitted by said limiting means.

10. A folding structure as claimed in claim 9 wherein: there are two of said limiting means.

11. A folding structure as claimed in claim 10 wherein:

said movable walls include curved lower edges which are spaced from said toggle linkage and said limiting means a sufficient extent so that when said structure is unfolded it can rock back and forth.

12. A folding structure as claimed in claim 10 wherein:

said limiting links of both of said limiting means extend downwardly from the remainder of said structure and have bilaterally symmetrical curved lower edges so that said structure can rock back and forth when unfolded.

13. A folding structure as claimed in claim 9 wherein: there are two of said toggle linkages.

14. A folding structure as claimed in claim 13 wherein:

said movable walls include curved lower edges which are spaced from said toggle linkage and said limiting means a sufficient extent so that when said structure is unfolded it can rock back and forth.

15. A folding structure as claimed in claim 13 wherein:

said toggle links of both of said toggle linkages extend downwardly from the remainder of said structures and have bilaterally symmetrical curved lower edges so that said structure can rock back and forth when unfolded.

16. A folding structure as claimed in claim 9 wherein: there are two of said toggle linkages and two of said limiting means.

* * * * *